United States Patent [19]

Dahl et al.

[11] 3,948,280

[45] Apr. 6, 1976

[54] COIN LIFTING DEVICE HAVING A FLEXIBLE ROTOR DISC

[75] Inventors: Lars Gunnar Dahl, Sodra Sandby; Kjell Gustav Landaeus, Lund, both of Sweden

[73] Assignee: Scan Coin AB, Malmo, Sweden

[22] Filed: Mar. 28, 1975

[21] Appl. No.: 563,267

[30] Foreign Application Priority Data

Apr. 2, 1974 Sweden ..... 7404415

[52] U.S. Cl. ..... 133/1 R

[51] Int. Cl.[2] ..... G07D 9/00

[58] Field of Search ..... 133/3 H, 3 E, 4 A, 3 R, 133/8 R, 1, 8 A, 8 E; 198/287; 221/260, 266, 254, 160, 169; 222/369

[56] References Cited

UNITED STATES PATENTS 2,635,730 4/1953 Seckula ..... 133/8 R 3,422,824 1/1969 Persson ..... 133/3 R

*Primary Examiner*—Stanley H. Tollberg

[57] ABSTRACT

A coin lifting device adapted to receive a large number of coins and to discharge these one by one, comprising a coin receptacle having a flexible rotary coin-lifting disc; a generally concave fixed support for the disc against the surface of which the disc rotates, assuming as it does so the general contour of the support; the support being arranged between vertical and horizontal positions so as to impart to the disc a steeper inclination to the horizontal in the upper part of the rotational path thereof than in the lower part thereof; and a plurality of coin carriers on the disc, displaceable between projecting and retracted positions by the rotation of the disc upon the support.

8 Claims, 10 Drawing Figures

COIN LIFTING DEVICE HAVING A FLEXIBLE ROTOR DISC

One type of a coin-lifting device adapted to receive a large number of coins and to discharge these one by one includes a coin receptacle having an inclined rotary disc with a number of coin carriers displaceable between a position projecting from the disc and a retracted position upon the rotation of the disc.

In such coin-lifting devices the disc has heretofore been rigid, and usually of metal, arranged at a predetermined inclined angle to the horizontal found empirically to provide optimum results in capacity, operation, and reliability. However, the angle of inclination has been a compromise between two opposed requirements: (1) in order to carry off coins most easily from the mass of coins in the receptacle, the rotating disc in the lower part of the rotational path should be horizontal, or as close to horizontal as possible; (2) in order to discharge the lifted coins, the disc in the upper part of the rotational path should be very nearly vertical, so that the coins can be easily moved off the disc, e.g. by being transferred to and allowed to roll along a discharge chute.

The disc must not, however, be exactly vertical in the upper part of the rotational path; some rearward inclination must be provided, in order to prevent the coins from falling off the disc into the coin receptacle when they reach the upper part of the rotational path. However, if this inclination is too large, difficulties will arise in discharge of the coins from the disc. The inclination in the upper part is determined by the discharge chute, if there be one, because the chute must have some rearward inclination, in order to prevent the coins from falling off the chute when rolling therealong. This rearward inclination must not be too large, or the friction of the coins against the discharge chute will be too large to permit uninterrupted smooth rolling of the coins along the chute. An abrupt transition between the disc and the discharge chute due to different inclinations thereof is not acceptable, because an abrupt change of direction of the coins during transfer from the disc to the chute may cause the coins to be thrown off from the disc and return again to the coin receptacle.

It has heretofore been preferred to adopt an inclination that favors a smooth and uninterrupted transfer of the coins from the disc to the discharge chute, rather than an inclination that in the horizontal or nearly horizontal position of the disc would make a large coin-lifting capacity possible. In order to compensate to some extent for the reduction of the lifting capacity thus provided by the relatively steeply inclined disc, it has been necessary to provide carriers on the disc that have a large protrusion, considerably greater than that corresponding to the smallest thickness of the coins, when the disc is in the lower part of the rotational path, and passes through the mass of coins. The carriers thus lift not one but several coins, and the excess coins fall off the disc as it becomes more inclined to the horizontal before they reach the upper part of the rotational path of the disc where the discharge of the coins takes place. The excess coins fall into the mass of coins in the coin receptacle, and this creates a high noise level during operation.

The invention overcomes these difficulties by providing a coin-lifting device having a high coin-lifting capacity and a high operational reliability during the continuous and uniform lifting and discharge of the coins. At the same time, the lifting is quieter because small carriers are used, so that excess coins are not lifted.

The coin-lifting device according to the invention comprises a coin receptacle; a rotary flexible coin-lifting disc; a fixed generally concave support for the disc, against the surface of which the disc rotates, assuming as it does so the general contour of the support; the support being arranged between vertical and horizontal positions to impart to the disc a steeper inclination to the horizontal in the upper part of the rotational path thereof than in the lower part thereof; and a plurality of coin carriers displaceable upon the rotation of the disc between projecting and retracted positions.

In order to illustrate the invention, preferred embodiments thereof are described in detail below, reference being made to the accompanying drawings, in which.

Figure 1:
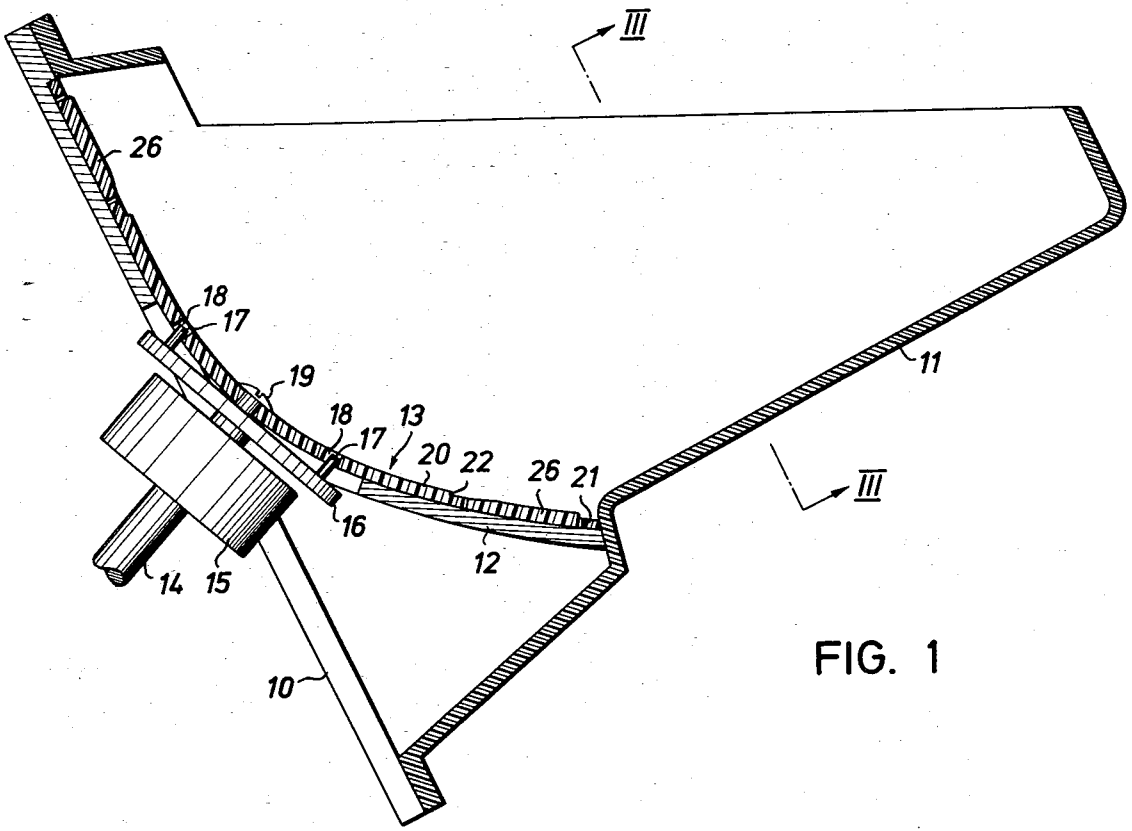
FIG. 1 is a vertical sectional view of one embodiment of a coin-lifting device according to the invention.

The coin-lifting device of the invention is adapted to form a part or portion of a coin-counting or-sorting machine, and in FIG. 1 such a machine is indicated generally as a frame portion 10. This frame portion supports a coin receptacle 11 for receiving a mass of coins, which is disposed for easy access on the front side of the machine. In this coin receptacle there is provided a concave wall 12 which serves as a support for a rotating coin-lifting disc 13; is cylindrically curved about substantially horizontal axis; and is inclined between vertical and horizontal positions.

The concave wall in its lower portion has an inclination to the horizontal of about 20°, and in its upper portion an inclination to the vertical of about 25°; these angles have been found empirically to be preferred for the embodiment described.

The resilient flexible circular disc 13 (of an elastomer such as urethane rubber, or any snythetic rubber or plastic, or of this steel sheet or other flexible metal sheet) is held in direct close contact with the fixed concave support 12, in order to conform to the contour thereof, being secured to a shaft 14. The shaft is inclined at an angle to the horizontal and rotates on roller or ball bearings in a bearing housing 15 arranged on the frame in a suitable way behind support 12, and is coupled to a drive motor.

The connection between shaft 14 and disc 13 is effected as follows: A circular plate 16 is fixedly secured to the shaft 14, and has four carrier dogs 17 received in holes 18 in the disc, which is secured centrally to the plate by means of a screw 19 having a shoulder at least the thickness of the disc, which spaces the head of screw 19 from the shaft end. Holes 18 are so large that they receive dogs 17 loosely, to allow movement between the dogs and the disc, due to the disc being curved.

Figure 5:
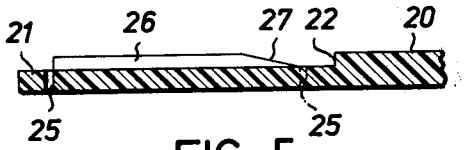
FIG. 5 is a sectional view along the line V—V of FIG. 4.
Figure 6:
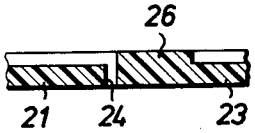
FIG. 6 is a sectional view along the line VI—VI of FIG. 4.
Figure 4:
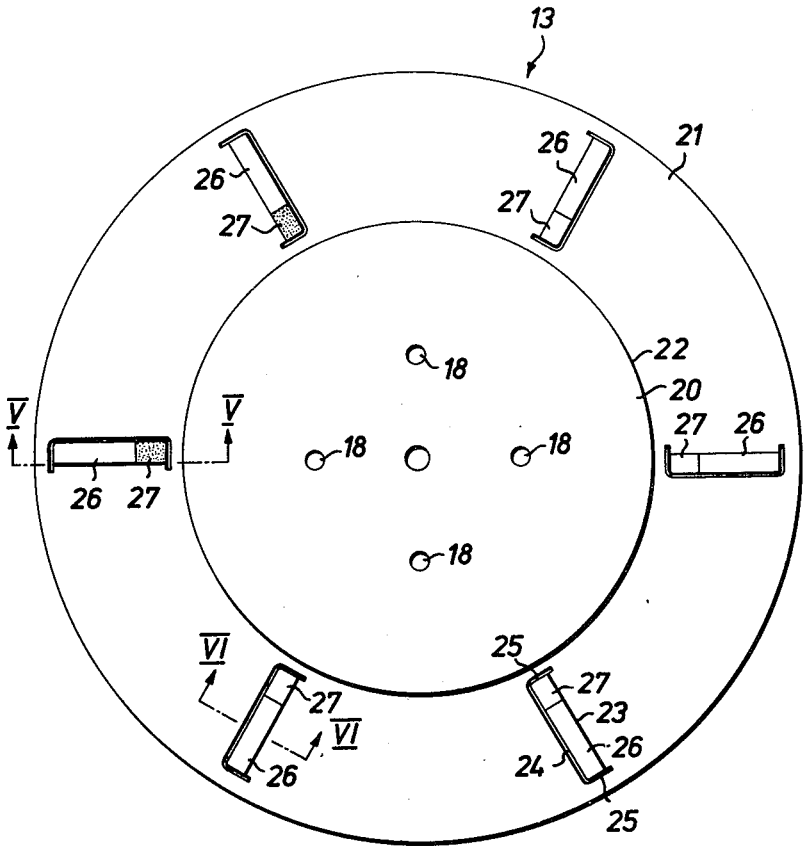
FIG. 4 is a plan view of the rotor disc in the embodiment according to FIGS. 1 to 3 as seen from the front side thereof.

The construction of disc 13 is shown in detail in FIGS. 4 to 6. The disc has a central portion 20 having a greater thickness than the outer periphery 21 of the disc, and between this portion 20 and outer annular portion 21 is a circular shoulder 22, portion 21 having a width which is at least as large as the diameter of the largest coin to be handled in the coin-lifting device. In the annular portion 21 there are cut out six rectangular flaps 23 having a longer edge 24, which may be identified as the radial edge although it deviates to some extent from the radial direction, and two shorter peripheral edges 25. Along the radial edge 24 of each carrier there extends a rib 26 which has the same height as shoulder 22, and is bevelled at 27 at the end thereof facing the shoulder. The height of the rib preferably is only as great as the thickness of the thinnest single coin.

Ribs 26 form the carriers for lifting the coins from the mass of coins in the coin receptacle, and they normally project from the front side of the disc, because the rear sides of the flaps are flush with the rear side of the disc. When the ribs pass through the coin receptacle during the rotation of the disc in contact with support 12, they will thus carry coins from the mass of coins in the coin receptacle 11. The inclination of the disc during the rotation thereof through the coin recepatcle is the optimum inclination for coin lifting at the greatest capacity. Since the ribs are only as high as the thinnest coin, only one layer of coins will be carried by each rib which means that superfluous coins slide off the disc before the disc leaves the receptacle, so that the noise of falling coins is eliminated substantially completely, and the noise level during the lifting of the coins is considerably reduced.

The last coin left in the coin receptacle tends to remain on the bottom of the coin receptacle, and to keep rolling against the rotating disc 13. This can be prevented by providing a shoulder 28 on the bottom of the coin receptacle. The coins are tilted over the shoulder and brought into contact with disc 13, so as to be carried and lifted thereby.

Figure 2:
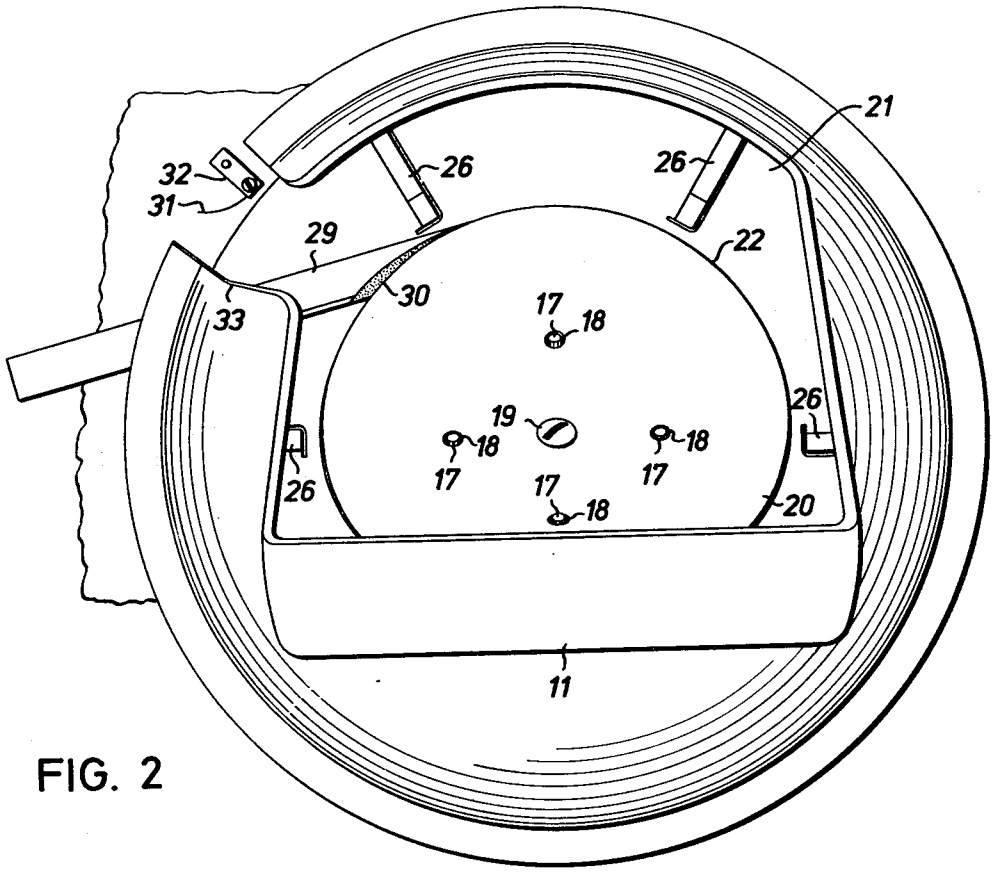
FIG. 2 is a front view of the coin-lifting device in FIG. 1.
Figure 3:
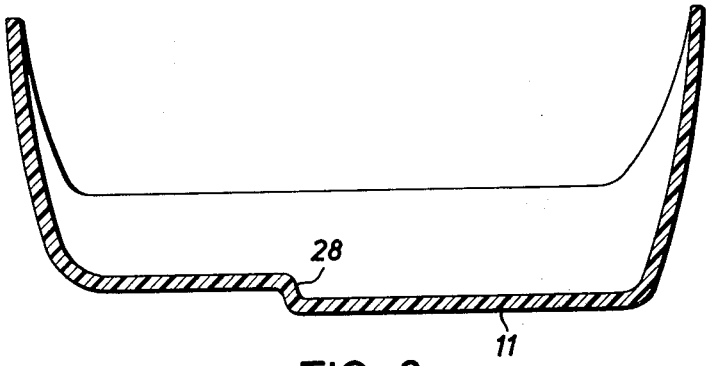
FIG. 3 is a sectional view along the line III—III of FIG. 1.

Coins carried by the rotating disc to the upper part of the rotational path of the disc are to be discharged from the disc in order to be supplied to a sorting and/or counting mechanism, and for this purpose there is provided a diverting knife 29, FIG. 2, having a bevelled end edge 30 placed so as to adjoin shoulder 22. The coins roll along the edge of the diverting knife, and in order to roll along the knife they must be supported at the rear in a position in which they are inclined somewhat rearwardly, and at the same time the knife must be inclined downwardly in the longitudinal direction thereof, so that the coins are made to roll by gravity.

The diverting knife engages or is close to the annular portion 21 of disc 13, and thus has the same inclination of 25° to the vertical as the upper portion of the disc. This inclination has been found to be suitable in combination with an inclination of the same order to the horizontal in the longitudinal direction of the knife, in order to stabilize the coins on the knife, and at the same time impart a suitable rolling speed thereto.

To the knife there may be connected a chute (not shown) having a corresponding inclination, which extends to a sorting or counting mechanism, and from which the rolling coins are discharged selectively according to the size (and value) thereof.

A coin which has been carried by a rib 26 on disc 13 and lifted to the upper part of the rotational path of the disc from the bulk of coins in the lower part of this rotational path thus will roll into the diverting knife. Since the knife engages the front side of portion 21, rib 26 will be pressed backwards by the knife during the rotation of the disc when passing the knife, this operation being facilitated by the fact that the rib if bevelled at 27, where it contacts the knife initially. A recess (an opening or a cup-like depression) is formed in support 12 in the area of rib 26. Each flap 23 will be pressed back or retracted against the inherent resiliency of the material of the flexible disc into the recess so that the carriers can pass the knife.

The bevelling of the end edge 30 of the diverting knife ensures that superfluous coins, i.e. coins which have been lifted but are not carried on by the diverting knife, are sent on a proper course back to the receptacle.

Two smaller coins may stand edgewise, one on the other, when passing along the discharge knife. This could interfere with the result of the sorting. In order to prevent this, there is provided above the knife a small steel wire spring 31, which is secured by means of a screw fitting 32. This spring extends in the direction of movement of the coins and is bent into the path of the coins. It is placed on a level such that coins of the major number of existing sizes pass below the spring, while very big and heavy coins push the spring aside to pass it. However, two smaller coins standing edgewise one on the other do not clear the spring, nor are they sufficiently heavy to be able to push the spring aside. Thus, the spring will divert at least the upper one of such coins from the knife, and return it to the mass of coins in the receptacle. The coin receptacle has an enlargement 33 to allow coins diverted by the spring to pass into the receptacle.

Figure 7:
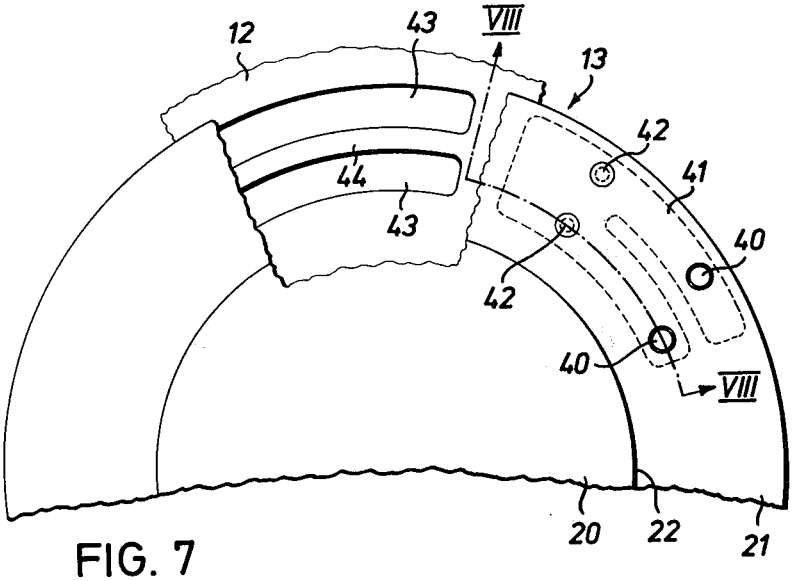
FIG. 7 is a fragmentary plan view of a second embodiment of the rotor disc as seen from the front side thereof.
Figure 8:
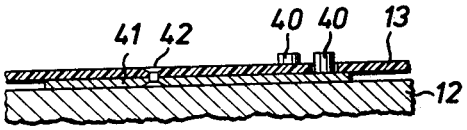
FIG. 8 is a sectional view along the line VIII—VIII of FIG. 7, having the carriers in an operative position.
Figure 9:
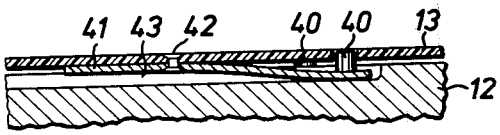
FIG. 9 is a corresponding sectional view but with the carriers in an inoperative position.

In the embodiment of the disc disclosed in FIGS. 7 to 9, the carriers are each formed by two pins 40, one to each of the two legs of a forked plate 41. The plate is of spring sheet metal, and is attached to the reverse side of the disc 13 by means of rivets 42, and can project beyond the surface on the front side of the disc through holes therein. The plate is not completely planar but is concave or dished away from the disc, so that the pins when the plate is not under stress are normally retracted from the front side of the disc, as shown in FIG. 9.

As in the embodiment previously described, the pins are to project during the major part of the rotational path of the disc, and to be retracted over the part thereof only where the coins have to be discharged from the disc. Thus, the pins will be projected in this case by the plate 41 engaging support 12 as is shown in FIG. 9, recesses 43 being formed in this wall to receive the fork limbs of the plate when the pins are to be retracted.

In this case, the dogs accordingly are forced to the operative position against the spring bias thereof, the pins being brought to the inoperative or retracted position by the spring bias, i.e., in the opposite way to that in the embodiment according to FIGS. 1 to 6. In order that the disc shall not be completely deprived of its support in the area of recesses 43, a supporting portion 44 remains in the area of these recesses. In the downstream end of the recesses there should be arranged a sloping bottom surface, for a smooth return of the pins to the projecting position thereof.

Pins 40 are not arranged on a radial line. The inner pin is displaced forwardly with respect to the intended rotational direction, which is counterclockwise. Thereby, the transfer of the coins to the diverting knife is facilitated. In this embodiment, the diverting knife may be arranged as described above, which is true also for other details such as the drive mechanism, the coin receptacle etc. However, in the present case the disc engages the supporting surface provided by the support not directly but over plates 41.

It is of course within the scope of the invention to arrange the carriers on the flexible disc in any way than that illustrated above that provides movement thereof between an operative and an inoperative position.

Although the invention has been characterized as a coin-lifting device it is obvious that it is applicable to tokens as well as coin-like discs such as circular blanks or rounds of metal sheet or plastics material which are to be counted or sorted or are to be arranged for a succeeding treatment in automatic machines of any type.

Having regard to the foregoing disclosure, the following is claimed as the inventive and patentable embodiments thereof:

1. A coin-lifting device adapted to receive a large number of coins and to discharge these one by one, comprising, in combination, a coin receptacle; a rotary flexible coin-lifting disc; a fixed generally concave support for the disc, against the surface of which the disc rotates, assuming as it does so the general contour of the support; the support being arranged between vertical and horizontal positions to impart to the disc a steeper inclination to the horizontal in the upper part of the rotational path thereof than in the lower part thereof; and a plurality of coin carriers in operative connection with the disc and rotated by the disc between coin-accepting and coin-discharging positions; the coin carriers being displaceable upon the rotation of the disc between projecting and retracted positions; and means for displacing the coin carriers to at least one of the projecting and retracted positions; the coin carriers in the projecting position being adapted to accept and lift coins from the receptacle to the discharge position, and at the discharge position being retracted to discharge coins therefrom.

2. A coin-lifting device according to claim 1, in which the support defines a recess receiving the carriers displaced into the retracted position.

3. A coin-lifting device according to claim 1 in which the coin carriers comprise a plurality of flaps integral with the disc and having coin-carrying means on the surface thereof.

4. A coin-lifting device according to claim 3 in which the coin-carrying means are ribs arranged substantially radially along the carrier surface.

5. A coin-lifting device according to claim 1, comprising a plurality of spring members attached beneath the disc, and to which the carriers are attached.

6. A coin-lifting device according to claim 1, in which the disc comprises a shoulder defining a coin-receiving annular peripheral portion along which portion the carriers are disposed.

7. A coin-lifting device according to claim 6, comprising means for displacing coins from the carriers, having an end portion extending over the annular peripheral portion of the disc adjacent the shoulder sufficient to engage coins held by a carrier and displace such coins from the carrier.

8. A coin-lifting device as claimed in claim 7 further comprising means arranged in the path of rotation of the disc in a position to engage coins on the carrier that are standing edgewise, one on the other, for the return thereof to the coin receptacle.

* * * * *